United States Patent [19]

Lien et al.

[11] Patent Number: 4,940,087

[45] Date of Patent: Jul. 10, 1990

[54] SEATING ARRANGEMENT AND STRUCTURE OF A SPOOL WITHIN A WELL CASING

[75] Inventors: Neil C. Lien; Donald G. Olsen, both of Evansville, Wis.

[73] Assignee: Baker Manufacturing Company, Evansville, Wis.

[21] Appl. No.: 357,528

[22] Filed: May 26, 1989

[51] Int. Cl.[5] ..... E21B 33/04; E21B 43/00

[52] U.S. Cl. ..... 166/88; 166/382; 285/18; 285/137.2; 285/140

[58] Field of Search ..... 166/85, 86, 88, 206, 166/207, 208, 382, 348; 285/141, 142, 143

[56] References Cited

U.S. PATENT DOCUMENTS

| | | | |
|---|---|---|---|
| Re. 20,529 | 10/1937 | Penick et al. | 166/85 UX |
| 1,825,774 | 10/1931 | Boynton | 166/88 X |
| 2,042,745 | 6/1936 | Thompson | 166/88 |
| 2,657,633 | 11/1953 | Baker et al. . | |
| 2,657,637 | 11/1953 | Baker . | |
| 2,771,956 | 11/1956 | Johnson | 166/88 |
| 3,155,401 | 11/1964 | Musolf | 166/88 X |
| 3,556,213 | 1/1971 | Kramer | 166/88 |
| 3,650,893 | 3/1972 | Lien | 176/1 |
| 4,298,065 | 11/1981 | Baski | 166/88 |
| 4,422,507 | 12/1983 | Reimert | 166/348 |
| 4,541,490 | 9/1985 | Bigbie et al. | 166/379 |
| 4,577,686 | 3/1986 | Milberger et al. | 166/208 |
| 4,773,477 | 9/1988 | Putch | 166/206 |

OTHER PUBLICATIONS

Blueprint of 14" Economy Spool by Baker Mfg. Co. dated Jun. 14, 1989.

Blueprint of 18" Submersible Spool by Baker Mfg. Co. dated Mar. 26, 1975.

*Primary Examiner*—Stephen J. Novosad

*Attorney, Agent, or Firm*—Lathrop & Clark

[57] ABSTRACT

A well construction includes a spool (12) that is insertable into a vertical well casing (14). The spool (12) has a skirt (28) that seats against a collar (26) of the well casing (14). The skirt (28) and collar (26) are of a preselected angle and material so as to create a sliding and non-sticking engagement between the surfaces of the skirt (28) and the collar (26). A support web (50) extends substantially perpendicular to the surface of the skirt (28) at the location of the skirt (28). A pipe is suspended from a sleeve portion (44) of the spool and a ring portion (53) is formed at the junction of the support web (50) and the sleeve (44). The sliding and non-sticking engagement between the skirt (28) and the collar (28), coupled with the geometry of the spool (12), creates a load distribution in the support web (50) of substantially compressive forces between the surfaces of the skirt (28) and the collar (28), thus minimizing the incidence of breakage in the spool (12).

10 Claims, 4 Drawing Sheets

SEATING ARRANGEMENT AND STRUCTURE OF A SPOOL WITHIN A WELL CASING

FIELD OF THE INVENTION

This invention relates generally to the removable portion of a well, or "spool," and particularly to the seating arrangement of the spool within the well casing.

BACKGROUND OF THE INVENTION

A typical form of well construction employs a tubular well casing that extends vertically downward from the surface of the earth. Lateral distribution from the well may be provided by an underground line below the frost level for the particular area. A spool, also known as a pitless adaptor, provides a connecting device between the well casing and the surface, provides seals for the line from the well to the lateral distribution line, and provides the sealed joint for the pump actuator or the pump motor electric lines. For maintenance purposes, the spool must be periodically removed by withdrawal through the well casing.

In the installation of the spool into the well casing, the spool is descended through the tubular well casing until the spool seats against either a protrusion in the well casing or against an area on the wall of the well casing where the well casing narrows. The spool is threadedly engaged with a pipe suspended therefrom, the length of which descends below a fluid table, usually a water table. The seating of the spool puts the spool at a proper depth within the casing to align with the lateral distribution line and to suspend the pipe that extends downward for the fluid table.

A typical spool of the prior art is configured to have two conical sections, the conical sections being joined at the middle of the spool such that the tapered ends of the conical sections are formed on opposite ends of the spool. Though this geometry sufficiently resolves the forces acting upon the spool, predominantly the weight of the suspended pipe, the result is that the spool is cast with a significant vertical dimension and requires use of large machining equipment. The large size of the spool also requires a large amount of material from which the spool is cast.

SUMMARY OF THE INVENTION

In accordance with the present invention, a well construction includes a spool with a skirt that seats against a collar in the vertical well casing. The collar is a beveled surface at a point in the well casing where the inside wall of the well casing has necked down or narrowed slightly. The skirt is a beveled surface on the underside of the spool which contacts the collar of the well casing. A structural support web of the spool extends perpendicular to the angle of the skirt at the location of the skirt. The particular angle and material of the skirt and the collar are selected so as to produce a sliding and non-sticking contact engagement. The spool also includes a sleeve from which a pipe is suspended and a ring portion at the junction of the sleeve and the support web, the force components being resolved at the centroid of the ring portion.

The sliding and non-sticking contact engagement produces substantially compressive forces between the skirt and the collar when a load is applied to the spool by the suspension of a pipe from the spool. These compressive forces are normal to the skirt and collar surfaces, and are absorbed by the structural support web of the spool that extends normal to the angle of the skirt, resulting in a load distribution that is not prone to breakage. The geometry of the spool of the present invention is such that the spool is more compact, having a shorter vertical dimension in that the lower conical section has been eliminated. Less material is used in the manufacture of the spool and the integrity and strength of the spool is retained. The more compact size allows for machining on smaller equipment.

Further objects, features, and advantages of the invention will be apparent from the following detailed description taken in conjunction with the accompanying drawings.

DESCRIPTION OF THE PREFERRED EMBODIMENT

Figure 1:
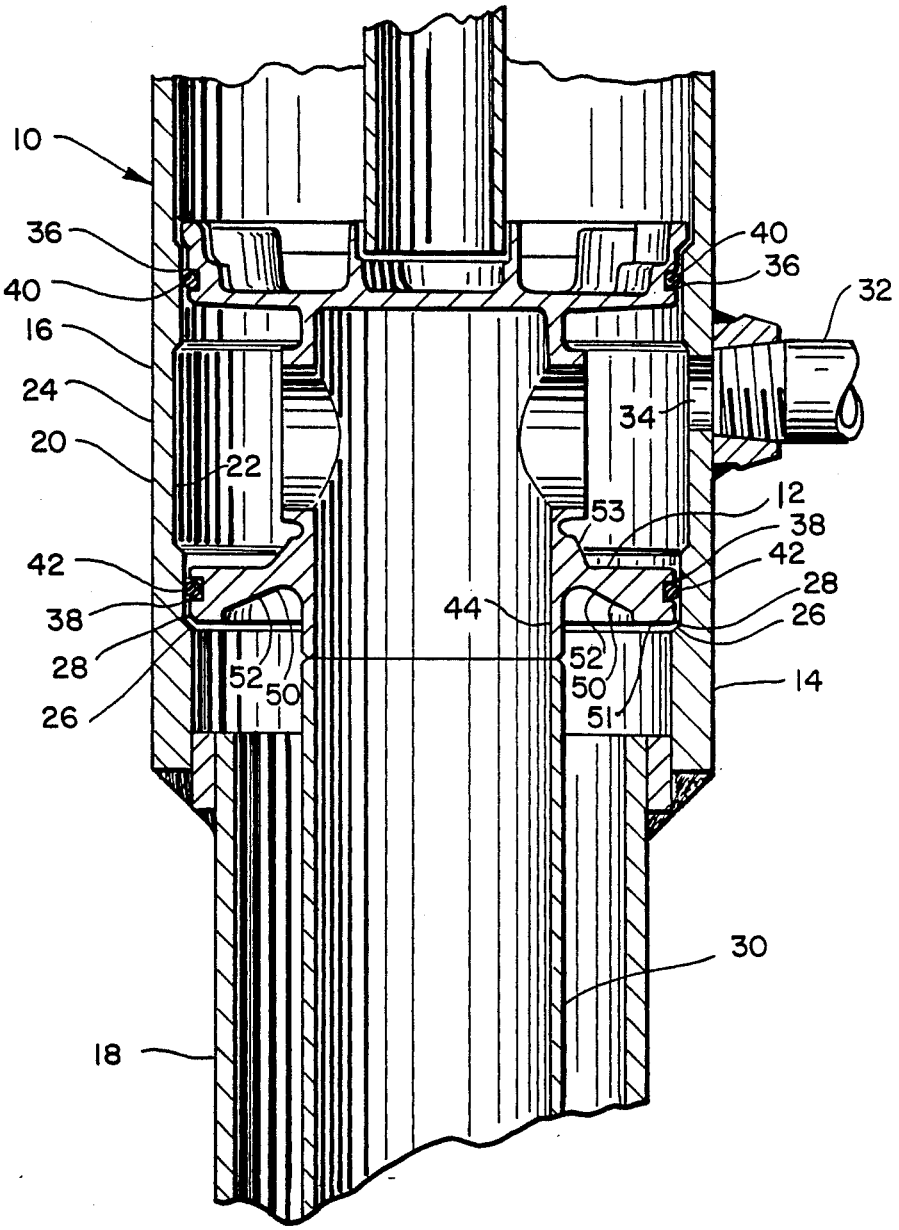
FIG. 1 is a fragmentary longitudinal vertical cross-section from the front showing a well construction of the present invention.
Figure 2:
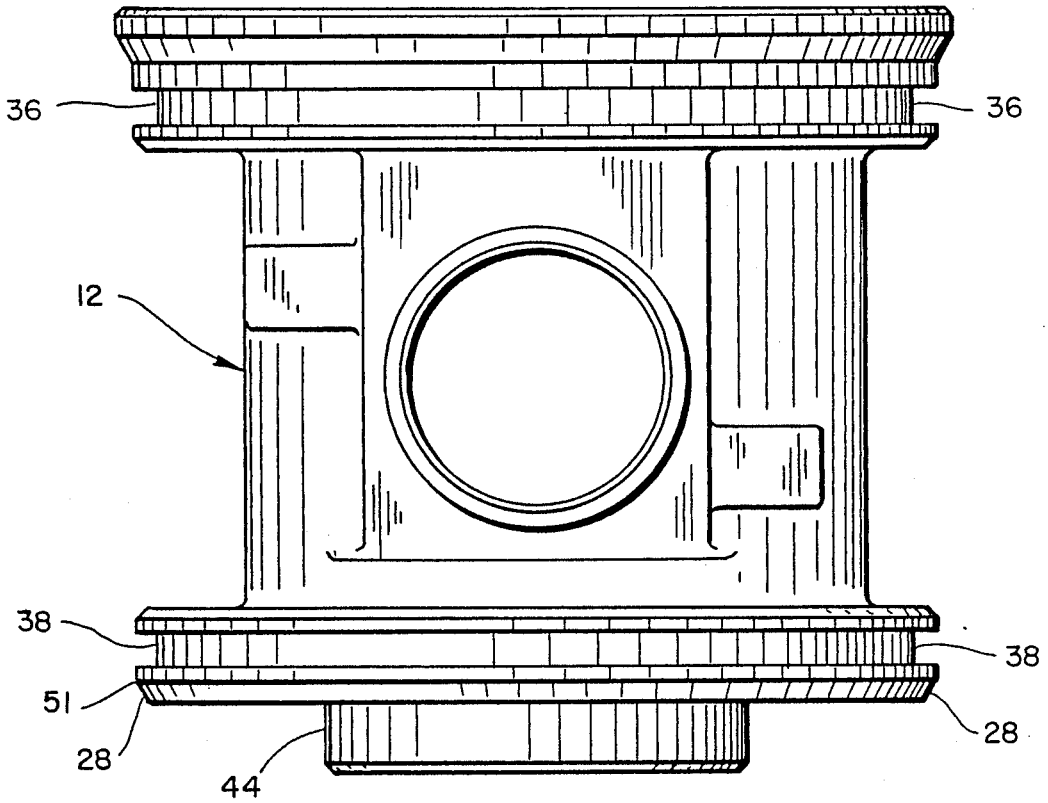
FIG. 2 is a side plan view of the spool of the present invention.

A well construction in accordance with the present invention is shown at 10 in FIG. 1 depicting a cross-section of a spool 12 within a well casing 14. The well casing 14 is a vertical tubing having an upper section 16 which extends downward from the surface of the earth, and a lower section 18. The upper section 16 has a circumferential wall 20 with an inside surface 22 and an outside surface 24. The inside surface 22 necks down at a collar 26, the collar 26 being a beveled surface extending around the circumference of the inside surface 22. The spool 12 fits within the inside surface 22 of the circumferential wall 20, and has a skirt 28 that is an angled surface which seats against the collar 26 when the spool 12 is lowered into position within the well casing 14. FIG. 2 shows a side plan view of the spool 12.

The lower section 18 of the well casing 14 is a cylindrical section which extends below the water table. A vertical pipe 30 is suspended from the spool 12 and hangs within the lower section 18, transporting water upward from the water table. A lateral delivery pipe 32 extends laterally beneath the frost line from an aperture 34 in the wall 20 and delivers water to a water storage tank, or other collecting means. A submersible pump (not shown) may be mounted on the vertical pipe 30 below the water table. Though the pump and associated parts are necessary parts of the well casing, such pumps are known in the art and the pump itself does not form a part of the invention. When the spool 12 is positioned within the well casing 14 such that the skirt 28 is seated against the collar 26, the spool 12 provides a connecting device between the well casing 14 and the surface of the earth, provides seals for the vertical pipe 30 from the well to the lateral delivery pipe 32, and provides a sealed joint for the pump actuator or the pump motor electric lines. The spool 12 has grooves 36 and 38 into which are positioned O-rings 40 and 42, respectively, to form the above-mentioned seals.

The spool 12 supports the weight of the vertical suction pipe 30 largely in the region of the skirt 28, where the skirt 28 contacts with the collar 26 to form a seated engagement. The vertical suction pipe 30 is suspended from the spool 12 by attachment with a sleeve 44 which forms part of the spool 12. The pipe 30 is shown in FIG. 1 to contact with and be welded to the sleeve 44, though the pipe 30 may be attached to and suspended from the spool 12 by other means, e.g. threaded engagement.

The seating of the skirt 28 of the spool 12 against the collar 26 forms a contact engagement which may be one of four types. The contact engagement may be either sliding and non-sticking, non-sliding and non-sticking, non-sliding and sticking, or sliding and sticking, depending upon the particular coefficient of friction ($\mu$) and the angle ($\theta$) of the contact surfaces. The contact engagement between the skirt 28 and the collar 26 in the well construction of the present invention is an engagement that is sliding and non-sticking. In order to achieve a sliding and non-sticking engagement between the skirt 28 and the collar 26, the skirt 28 and the collar 26 should be angled at an angle $\theta$ relative to the vertical such that $\theta$ has a value less than tan $\theta$ equal to $1/\mu$ and greater than tan $\theta$ equal to $\mu$, where $\mu$ equals the coefficient of friction. The derivation of these equations is shown in U.S. Pat. No. 3,650,893 issued to Lien, and incorporated herein by reference. A graphical representation plotting angle ($\theta$) against coefficient of friction ($\mu$) and mapping the regions of the sliding and non-sticking, non-sliding and non-sticking, non-sliding and sticking, and sliding and sticking is shown at FIG. 2 of U.S. Pat. No. 3,650,893.

In the preferred embodiment of the invention, the surfaces of the skirt 28 and the collar 26 are galvanized, the zinc coating thereby providing an appropriate coefficient of friction when the angle of the surfaces are considered as well as providing corrosion resistance. The coefficient of friction of zinc on zinc at room temperature is approximately 0.6. The corresponding range of allowable angles which do not then stick and do slide is between approximately 30° and 60°. In the instant case, the preferred angle is approximately 30°. It is to be understood that other materials and angles are possible under the invention herein described, so long as the combination of materials and angle of surface contact provide the desired sliding and non-sticking engagement between the skirt 28 and the collar 26. Lubricants or other coatings may also be incorporated to create a coefficient of friction which, in combination with an appropriate angle would create a sliding and non-stick engagement between the skirt 28 and the collar 26.

The spool 12 of the well construction of the present invention has a configuration such that the spool 12 includes a structural support web 50 that extends substantially perpendicular to the surface of the skirt 28 at the location of the skirt 28. The skirt 28 is formed as part of a flange 51 to which the support web 50 is connected, the flange 51 being directed outward and downward from the support web 50. The support web undersurface 52 is undercut to extend upwardly and radially inwardly from the flange 51. The sliding and non-sticking engagement of the skirt 28 of the spool 12 against the collar 26 distributes substantially compressive forces normal to the surface of the collar 26 through the structural support web 50. The sleeve 44 experiences substantially forces of tension from the weight of the suspended pipe 30. A ring portion 53 is formed at the junction of the support web 50 and the sleeve 44, the tensile forces experienced by the sleeve 44 and the compressive forces experienced by the support web being transmitted to the centroid of the ring portion 53, about which the force components are resolved. The sliding and non-sticking engagement of the skirt 28 against the collar, combined with the structural configuration of the support web 50 that extends substantially perpendicular from the surface of the skirt 28, the ring portion 53, and the sleeve 44 thus provide a spool 12 that distributes forces in a manner such that the spool 12 is not prone to breakage. The configuration of the spool 12 of the present invention is such that it requires the casting of an inner core and an outer core the outer core resulting from the undercut provided by the outward and downward directed flange 51.

Figure 3A:
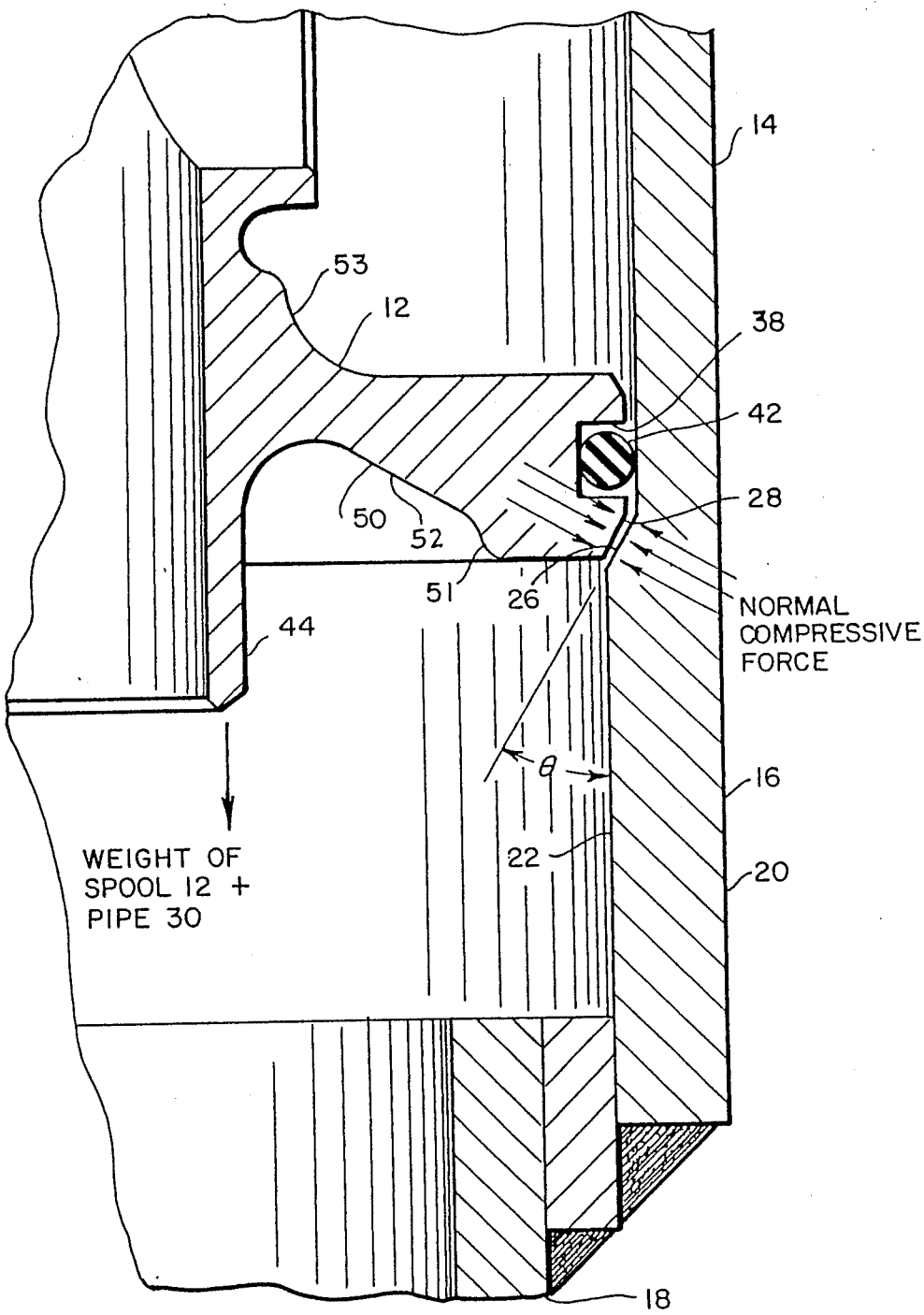
FIG. 3A is a fragmentary cross-sectional view of the seating arrangement and structural configuration of the spool of the present invention.
Figure 3B:
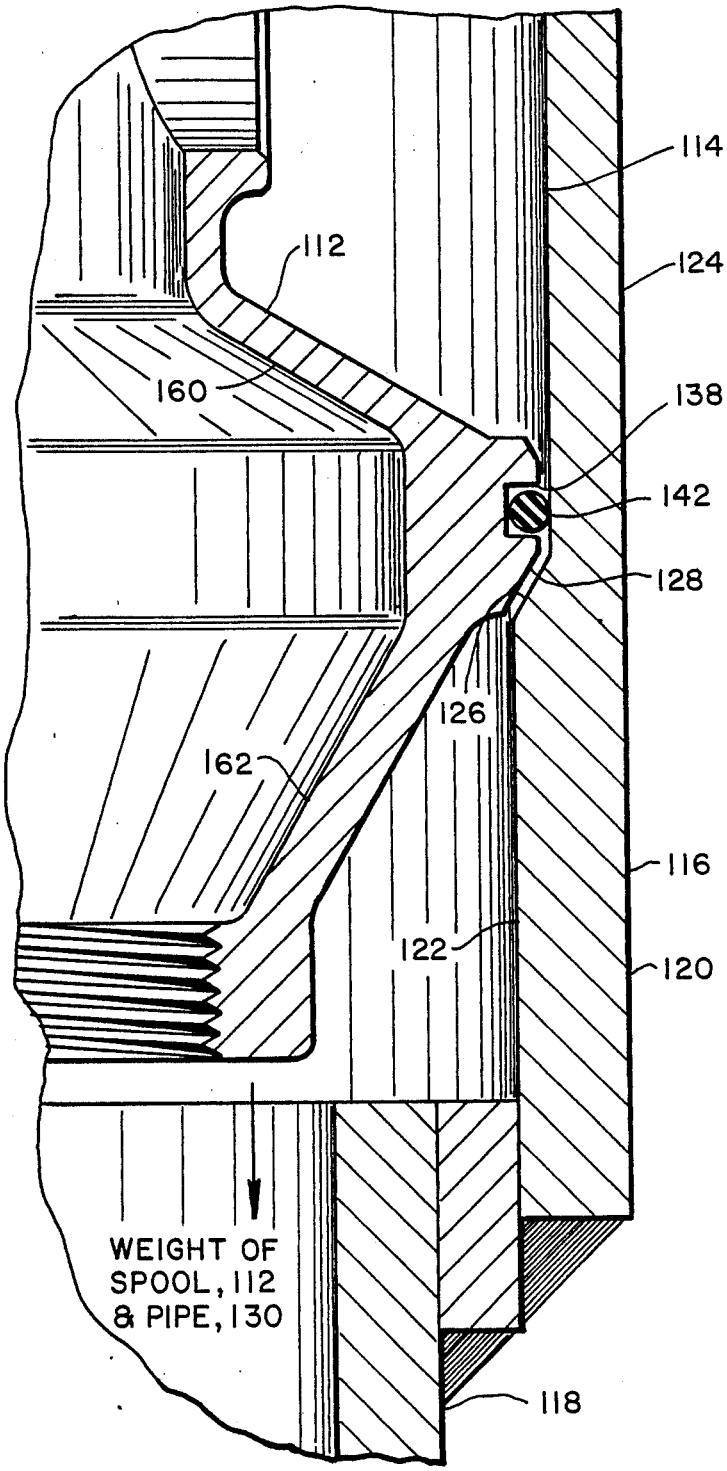
FIG. 3B is an exemplary fragmentary cross-sectional view of the seating arrangement and structural configuration of a typical prior art spool.

FIG. 3B shows an exemplary design of the well construction of the prior art, having a spool 112, well casing 114, upper and lower sections 116 and 118, a circumferential wall 120 having an inside surface 122 and an outside surface 124, a collar 126, a skirt 128, a pipe 130, a groove 138, and an O-ring 142, all parts which are analogous to corresponding parts of the present invention. There are additional parts of the depiction of FIG. 3B of the prior art that are similarly analogous and are, however, not shown in the view of FIG. 3B. The prior art design of FIG. 3B also includes conical sections 160 and 162. The forces acting upon the spool 112 of the prior art are such that the lower conical section 162 is under tension. The configuration of the spool 112 of the prior art differs from that of the present invention in that it requires the casting of a single core, but is longer in vertical dimensions and requires the use of more material to manufacture. The spool 12 of the present invention eliminates the lower conical section 162 and results in a spool 12 of shorter vertical dimension that retains its strength by use of the sliding and non-sticking engagement and the geometrical configuration described above. The shorter dimensioned spool 12 uses less material and may be machined on small equipment.

It is to be further understood that the invention is not confined to the particular constuction and arrangement of parts herein illustrated and described, but embraces such modified forms thereof as come within the scope of the following claims.

What is claimed is:

1. A well construction having a vertical well casing and a spool, the spool being insertable into the well casing and the spool having a flange with a skirt that bottoms against a collar in the well casing to form a seated contact engagement between the skirt and the collar, a support web connected to the flange and extending substantially perpendicular to the skirt, the support web having an undersurface which extends upwardly and radially inwardly from the flange, a sleeve section connected to the web radially inwardly thereof from which a pipe section is suspended therefrom, and a ring portion at a junction of the support web and the sleeve about which transmitted forces are resolved, the skirt and the collar being angled at an angle $\theta$ relative to the vertical such that $\theta$ has a value less than tan $\theta$ equal to $1/\mu$ and greater than tan $\theta$ equal to $\mu$ where $\mu$ equals the coefficient of static friction between the skirt and the collar.

2. The well construction of claim 1 wherein engaged surfaces of the skirt and the collar have been galvanized.

3. The well construction of claim 2 wherein the angle $\theta$ of the skirt and collar is between approximately 30° and 60°.

4. The well construction of claim 3 wherein the angle $\theta$ of the skirt and collar is approximately 30°.

5. A spool for use in a well construction in which a spool is insertable into a vertical well casing and the well casing has a collar upon which the spool rests, the spool comprising:

(a) a skirt that bottoms against the collar of the well casing to form a seated contact engagement between the skirt and the collar, the skirt being angled at an angle $\theta$ relative to the vertical such that $\theta$ has a value less than tan $\theta$ equal to $/\mu$ and greater than tan $\theta$ equal to $\mu$- where $\mu$ equals the coefficient of static friction between the skirt and the collar;

(b) a support web connected to the flange and extending substantially perpendicular to the skirt, the support web having an undersurface which extends upwardly and radially inwardly from the flange;

(c) a sleeve section connected to the web radially inwardly thereof from which a pipe section may be suspended from the spool; and (d) a ring portion at a junction of the support web and the sleeve about which transmitted forces are resolved.

6. The spool of claim 5 wherein the surface of the skirt has been galvanized.

7. The spool of claim 5 wherein the angle $\theta$ of the skirt is between approximately 30° and 60°.

8. The spool of claim 5 wherein the angle $\theta$ of the skirt is approximately 30°.

9. A well construction having a vertical well casing and a spool, the spool having a skirt that bottoms against a collar in the well casing to form a seated contact engagement between the skirt and the collar, a support web connected to the flange and extending substantially perpendicular to the skirt at the location of the skirt, the support web having an undersurface which extends upwardly and radially inwardly from the flange, a sleeve section connected to the web radially inwardly thereof from which a pipe section is suspended therefrom, and a ring portion at a junction of the support web and the sleeve about which transmitted forces are resolved, the spool being insertable into the well casing and the spool experiencing substantially compressive forces along the length of the support web resulting from the weight of the pipe section at the point of seated contact engagement between the skirt and the collar.

10. A spool for use in a well construction in which a spool is insertable into a vertical well casing and the well casing has a collar upon which the spool rests, the spool comprising:

(a) a skirt that bottoms against the collar of the well casing to form a seated engagement between the skirt and the collar;

(b) a support web connected to the flange and extending substantially perpendicular to the skirt, the support web having an undersurface which extends upwardly and radially inwardly from the flange, the spool experiencing substantially compressive forces along the length of the support web resulting from the weight of the pipe section at the point of seated contact engagement between the skirt and the collar;

(c) a sleeve section connected to the web radially inwardly therefrom from which a pipe section may be suspended from the spool; and (d) a ring portion at a junction of the support web and the sleeve about which transmitted forces are resolved.

* * * * *